US005730660A

United States Patent [19]

Young

[11] Patent Number: 5,730,660

[45] Date of Patent: Mar. 24, 1998

[54] SAND TRAP PRACTICE DEVICE

[76] Inventor: William Andrew Young, 66 Lodgepole Ct., Evergreen, Colo. 80439

[21] Appl. No.: 779,978

[22] Filed: Dec. 23, 1996

[51] Int. Cl.[6] ..... A63B 69/36

[52] U.S. Cl. ..... 473/262; 473/158; 473/265; 473/405

[58] Field of Search ..... 473/257, 262, 473/265, 278, 158, 405; 273/191, 192, 186

[56] References Cited

U.S. PATENT DOCUMENTS

| | | | |
|---|---|---|---|
| 2,370,529 | 2/1945 | Fuller | 273/33 |
| 3,025,059 | 3/1962 | DiBuono | 273/32 |
| 3,348,847 | 10/1967 | Fischl | 473/262 |
| 3,540,734 | 11/1970 | Temple | 273/181 |
| 3,561,764 | 2/1971 | Thomas | 273/183 |
| 4,535,980 | 8/1985 | Lovin | 273/176 FB |
| 4,535,989 | 8/1985 | Lovin | 473/278 X |
| 4,630,828 | 12/1986 | Lovin | 273/176 FB |

FOREIGN PATENT DOCUMENTS 464220 4/1937 United Kingdom .

OTHER PUBLICATIONS

Michael Konik; "Selling Short"; *Sky*; Oct. 1996; pp. 43, 44 and 46.

*Primary Examiner*—George J. Marlo

*Attorney, Agent, or Firm*—Webb Ziesenheim Bruening Logsdon Orkin & Hanson, P.C.

[57] ABSTRACT

A sand trap practice device includes a one piece, integral trough including a substantially rectangular base and a pair of side rails extending upwardly from the base and extending along opposed longitudinal sides of the base. A flexible tee is attached to the base along the center line of the base extending upwardly from the base substantially the same as the height as the side rails. Visual indicia is positioned on top surfaces of the side rails behind the tee indicative of proper club positioning. Additionally, sand is supported on the base between the rails extending to the top surface of the tee and the side rails. In operation, a golf ball is placed on the flexible tee, a golfer addresses the ball and swings away making sure the club does not hit the ball but instead enters the sand indicated by the visual indicia. The base will not permit the club to dig into the sand to excessive amounts such that the ball will come out of the bunker each time.

20 Claims, 2 Drawing Sheets

SAND TRAP PRACTICE DEVICE

BACKGROUND OF THE INVENTION

1. Field of the Invention

The present invention relates to golf practice devices, and more specifically the present invention relates to sand trap or bunker practice devices.

2. Prior Art

Properly hitting out of a sand trap or bunker represents one of the most difficult shots in golf. Despite a large variety of golf practice and training devices for driving, putting and chipping, there are no devices for effectively training a golfer to hit a golf ball out of a sand trap.

There are several golf-related devices specifically directed towards sand traps. For example, U.S. Pat. No. 3,025,059 to Di Buono discloses a sand trap golfing game which allows the user to practice hitting golf balls out of a reservoir of sand. U.S. Pat. Nos. 4,535,989 and 4,630,828 both to Lovin disclose a portable sand trap practice device comprising essentially a box filled with sand. The Lovin patents disclose the use of a golf aiming device formed of a pair of perpendicular panels which can be embedded in the sand to provide a guide or target for aligning or aiming of the golf shot.

These prior art devices, however, do not effectively train the golfer in the appropriate swing for properly hitting a golf ball out of a sand trap. Specifically, there is a need to train the golfer to swing properly relative to the sand and ball position. Additionally, it is preferable that the practice device give feedback to the user to indicate proper or improper swings.

It is the object of the present invention to overcome the aforementioned drawbacks of the prior art. It is a further object of the present invention to provide an efficient sand trap practice device which trains the golfer for proper swings. It is a further object of the present invention to provide a sand trap practice device which gives feedback to the golfer for improper swings. It is a further object of the present invention to provide a sand trap practice device which is easily manufactured, easily used, and easily portable.

SUMMARY OF THE INVENTION

The above objects are achieved by providing a golf practice device which includes a trough member with a base, at least one side rail extending upwardly from the base, and a tee attached to the base extending upwardly from the base substantially the same height as the side rail.

In one embodiment of the present invention, a sand trap practice device is formed of a one piece, integral trough member which includes a substantially rectangular base and a pair of side rails extending upwardly from the base and extending along opposed longitudinal sides of the base. A flexible rubber tee is attached to the base along the center line of the base, whereby the tee is substantially centered between the side rails. The tee extends upwardly from the base substantially the same height as the side rails. The side rails include visual indicia on top surfaces thereof behind the tee which are indicative of proper club positioning during the swing. The trough is adapted to support sand therein to the top surface of the side rails and the tee.

The trough can be formed of molded plastic with dimensions of the base being about 6 inches wide and about 16 inches long. The tee may be formed about 4 inches back from the base with a visual indicia 2 inches behind the tee measured along the longitudinal center line of the base.

In operation the sand trap practice device of the present invention can be placed in a practice bunker and filled with sand up to the edges of the side rails and to the upper surface of the tee. A golf ball is placed on the rubber tee. The golfer addresses the ball, opens the face of the club, e.g., a sand wedge, and swings away. The golfer should make sure that the club does not hit the ball but instead enters the sand at a point indicated by the visual indicia, such as arrows. The base of the practice device will not permit the club to dig into the sand to an excessive amount such that the ball will come out of the bunker with every swing. The base also serves as a feedback mechanism indicating to the golfer when the swing is improper and the club face is too deep in the sand if the club strikes the base.

These and other objects of the invention will be clarified in the description of the preferred embodiment taken together with the attached drawings wherein like reference numerals represent like characters throughout.

BRIEF DESCRIPTION OF THE PREFERRED EMBODIMENT

Figure 1:
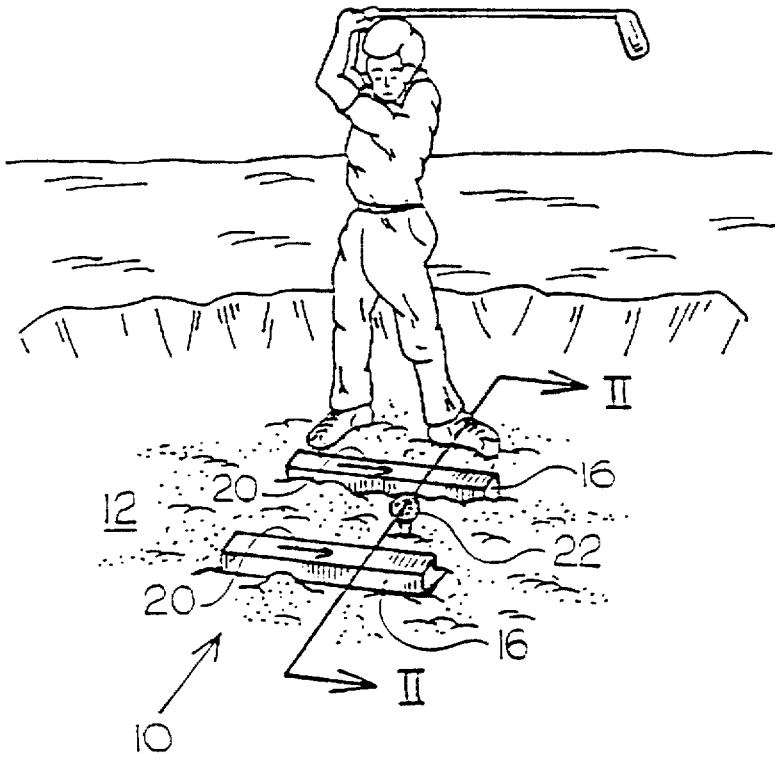
FIG. 1 is a perspective view of a sand trap practice device according to the present invention positioned in a bunker.

FIG. 1 illustrates a preferred sand trap practice device 10 positioned in a bunker or sand trap 12 for training a golfer in the proper swing required for appropriately hitting a golf ball out of the sand trap 12 as will be described hereinafter.

Figure 3:
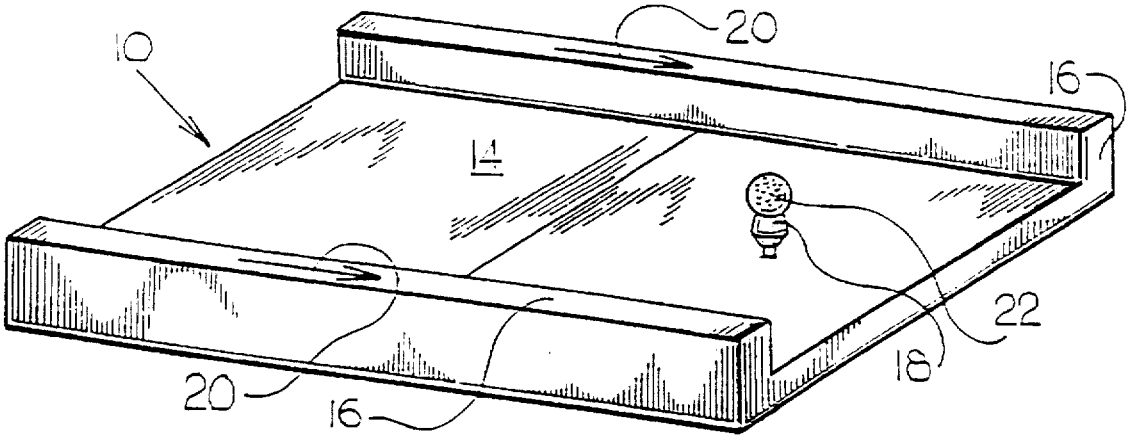
FIG. 3 is a perspective view of the sand trap practice device according to the present invention.
Figure 4:
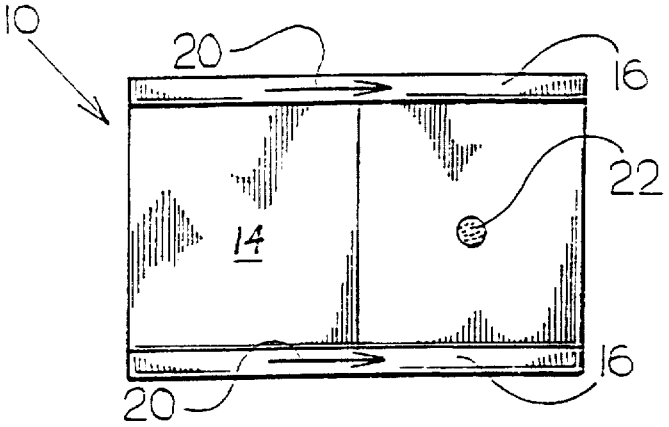
FIG. 4 is a plan view of the sand trap practice device illustrated in FIG. 3.
Figure 5:
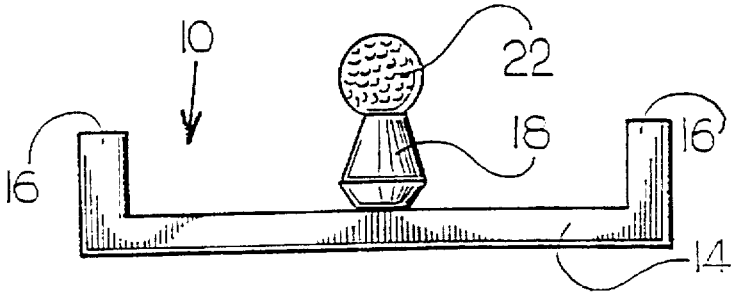
FIG. 5 is a front view of the sand trap practice device illustrated in FIG. 3.

The sand trap practice device 10 is shown in greater detail in FIGS. 3–5. The sand trap practice device 10 includes a substantially rectangular base 14 and a pair of opposed side rails 16 extending upwardly from the base 14 on opposed sides thereof. The base 14 and side rails 16 may be formed integrally from plastic material, such as molded plastic or the like. The rectangular base 14 is approximately 6 inches wide and 16 inches long with each of the side rails 16 extending approximately 1½ inches above the base 14. This construction provides an easily portable sand trap practice device 10.

Figure 2:
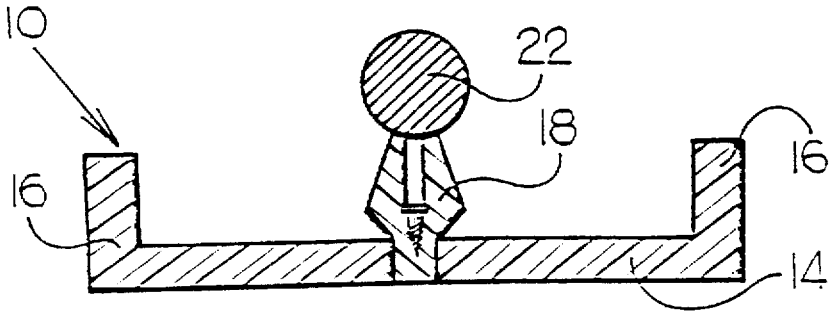
FIG. 2 is an enlarged, sectional view of the sand trap practice device taken along lines II—II of FIG. 1.

A flexible rubber tee 18 is attached to the base 14 along the center line of the base 14 about 4 inches behind the leading edge of the base 14. The flexible rubber tee 18 is thereby centered between the opposed side rails 16 as best shown in FIG. 5. Tee 18 extends above the base 14 to substantially the same height as the side rails 16 as best shown in FIGS. 2 and 5. As will be apparent from the operation of the sand trap practice device 10, the side rails 16 should extend at least to the height of the tee 18.

Visible indicia, such as arrows 20 are provided on the top surface of each side rail 16, each positioned approximately 2 inches behind the tee 18 as measured along the center line of the base 14. As will be described hereinafter, the arrows 20 serve as visual indicia for the golfer to illustrate proper club positioning during a swing.

The base 14 and side rails 16 form a trough which is adapted to be filled with sand as illustrated in FIGS. 1 and 2. In operation, the sand trap practice device 10 is positioned in a bunker or sand trap 12 and sand replaced on the base 14 up to the top surface of the side rails 16 and the top surface of the tee 18 as shown in FIG. 2. The ball 22 is then placed on the tee 18. Thereafter, the golfer can address the ball and swing away as shown in FIG. 1. The arrows 20 will serve as visual indicia for the golfer to indicate where the club head should enter the sand. Furthermore, the base 14 will prevent the club head from entering the sand an excessive amount such that the ball 22 will come out of the sand trap 12 with every swing. If the club head does hit the base 14, the base 14 will provide audible and tactile feedback to the golfer to indicate an improper swing. The sand trap practice device 10 of the present invention provides a very easy to use, efficient training aid for a golfer to practice proper sand trap shots.

It will, of course, be apparent to those of ordinary skill in the art that various modifications may be made to the present invention without departing from the spirit and scope thereof. Consequently, the scope of the present invention is intended to be defined by the appended claims.

I claim:

1. A golf practice device comprising:

a trough member including a base, at least one side rail extending upwardly from said base; and a tee adapted to support a golf ball, said tee attached to said base and extending upwardly from said base substantially the same height as said at least one side rail.

2. The practice device of claim 1 wherein each said side rail includes visual indicia thereon at a position indicative of a desired club positioning during a swing.

3. The practice device of claim 1 wherein a pair of said side rails are positioned on said trough member on opposed longitudinal sides of said base.

4. The practice device of claim 3 wherein said trough is filled with sand up to top edges of said pair of side rails.

5. The practice device of claim 3 wherein said tee is a flexible tee mounted substantially along a central line of said base.

6. The practice device of claim 5 wherein each said side rail of said pair of side rails includes visual indicia thereon at a position indicative of a desired club positioning.

7. The practice device of claim 6 wherein said trough is filled with sand up to top edges of said side rails and wherein said visual indicia are on a top surface of each said side rail positioned an equal distance behind said tee indicative of a position where the club head should enter said sand.

8. The practice device of claim 7 wherein said side rails and said tee extend about 1½ inches above said base and said visual indicia are positioned about 2 inches behind said tee.

9. A sand trap practice device comprising:

a base;

a pair of side rails on opposite sides of said base;

a tee for supporting a golf ball attached to said base between said side rails; and sand supported on said base between said side rails extending to a top of said tee.

10. The sand trap practice device of claim 9 wherein said side rails extend above said base to at least the same height as said tee.

11. The sand trap practice device of claim 10 wherein said tee is a flexible rubber tee mounted substantially along a center line of said base and substantially the same height above said base as said side rails.

12. The sand trap practice device of claim 11 further including visual indicia indicative of a desired position where the club head should enter said sand.

13. The sand trap practice device of claim 12 further including visual indicia on a top surface of said side rails indicative of a desired position where the club head should enter said sand.

14. The sand trap practice device of claim 13 wherein said visual indicia comprises a pair of aligned arrows on said top surfaces of said side rails.

15. The sand trap practice device of claim 9 wherein said tee and said side rails extend about 1½ inches above said base.

16. A sand trap practice device comprising:

a one piece, integral trough including a substantially rectangular base and a pair of side rails extending upwardly from said base and extending on opposed longitudinal sides of said base;

a flexible tee attached to said base along the center line of said base wherein said tee is substantially centered between said side rails, said tee extending up from said base substantially the same height as said side rails; and visual indicia on said trough indicative of a desired club positioning during a swing.

17. The sand trap practice device of claim 16 wherein said trough is formed of plastic and said tee is formed of rubber, and further including sand supported in said trough extending up to a top of said side rails and said tee.

18. The sand trap practice device of claim 16 wherein said side rails and said tee extend about 1½ inches above said base.

19. The sand trap practice device of claim 18 wherein said base is about 6 inches wide and about 16 inches long with said tee positioned about 4 inches back from a forward edge of said base.

20. The sand trap practice device of claim 19 wherein said visual indicia are on a top surface of each of said side rails positioned about 2 inches behind said tee as measured along said center line.

* * * * *